US008969702B2

(12) United States Patent
Takabayashi

(10) Patent No.: US 8,969,702 B2
(45) Date of Patent: Mar. 3, 2015

(54) PICKUP UNIT OF ELECTRIC STRINGED INSTRUMENT

(75) Inventor: Yojiro Takabayashi, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 12/790,539

(22) Filed: May 28, 2010

(65) Prior Publication Data

US 2010/0307324 A1 Dec. 9, 2010

(30) Foreign Application Priority Data

Jun. 3, 2009 (JP) ..... 2009-133812

(51) Int. Cl.
*G10H 3/14* (2006.01)
*G10H 3/18* (2006.01)

(52) U.S. Cl.
CPC ..... *G10H 3/143* (2013.01); *G10H 3/185* (2013.01); *G10H 2220/471* (2013.01); *G10H 2220/485* (2013.01)
USPC ..... 84/730; 84/723; 84/731

(58) Field of Classification Search
CPC . G10H 3/185; G10H 3/143; G10H 2220/525; G10H 3/14; G10H 3/18; G10H 3/186; G10H 2210/201; G10H 3/00; G10H 3/146; G10H 3/181; G10H 3/22; G10H 2220/465; G10H 2220/491; G10H 2220/501; G10H 2220/531; G10H 3/183; G10D 3/00
See application file for complete search history.

(56) References Cited

U.S. PATENT DOCUMENTS

| | | | | |
|---|---|---|---|---|
| 4,290,331 | A | 9/1981 | Izdebski | |
| 4,491,051 | A * | 1/1985 | Barcus | 84/731 |
| 4,657,114 | A * | 4/1987 | Shaw | 84/731 |
| 5,410,101 | A * | 4/1995 | Sakurai | 84/731 |
| 5,455,381 | A | 10/1995 | Juszkiewicz et al. | |
| 5,539,147 | A * | 7/1996 | Hoshino | 84/723 |
| 5,817,966 | A * | 10/1998 | Fishman | 84/731 |
| 6,023,019 | A * | 2/2000 | Baggs | 84/731 |

(Continued)

FOREIGN PATENT DOCUMENTS

| | | | |
|---|---|---|---|
| CN | 1445750 | A | 10/2003 |
| CN | 1573913 | A | 2/2005 |

(Continued)

OTHER PUBLICATIONS

Chinese Office Action, issuing date Feb. 28, 2012, for Chinese Patent Appl. 201010194890.6 (English translation attached).

(Continued)

*Primary Examiner* — Marlon Fletcher
(74) *Attorney, Agent, or Firm* — Dickstein Shapiro LLP

(57) ABSTRACT

A pickup unit of an electric stringed instrument is constituted of a vibrator supporting strings, a support which is installed inside the recess of a lower bridge so as to support the vibrator, and a plurality of piezoelectric elements which convert vibrations of strings transmitted thereto via the vibrator into electric signals. At least one presser member is interposed between the vibrator and the support. The presser member is constituted of a screw that is put into the lower surface of the vibrator from the lower surface of the support, thus upwardly pressing the piezoelectric elements onto the vibrator. This makes it possible to efficiently transmit vibrations of strings to the piezoelectric elements, thus improving the tone color and sound quality of an electric stringed instrument.

15 Claims, 4 Drawing Sheets

(56) References Cited

U.S. PATENT DOCUMENTS

| | | | | |
|---|---|---|---|---|
| 6,242,683 | B1 * | 6/2001 | Raisanen et al. | 84/733 |
| 6,326,532 | B1 * | 12/2001 | Antaki | 84/377 |
| 6,605,771 | B1 * | 8/2003 | Baggs | 84/731 |
| 6,689,943 | B2 * | 2/2004 | McGuire et al. | 84/291 |
| 6,689,948 | B2 * | 2/2004 | Raisanen | 84/733 |
| 6,822,156 | B1 * | 11/2004 | Lazarus et al. | 84/731 |
| 7,151,216 | B1 * | 12/2006 | Hutmacher | 84/723 |
| 7,288,713 | B2 * | 10/2007 | Krozack et al. | 84/726 |
| 7,394,015 | B2 * | 7/2008 | Takabayashi | 84/731 |
| 2003/0172793 | A1 * | 9/2003 | Hori | 84/298 |
| 2004/0134330 | A1 * | 7/2004 | Braun et al. | 84/298 |
| 2005/0150365 | A1 * | 7/2005 | Krozack et al. | 84/726 |
| 2005/0188814 | A1 * | 9/2005 | Bell et al. | 84/298 |
| 2005/0257670 | A1 * | 11/2005 | Takabayashi | 84/730 |
| 2006/0107826 | A1 * | 5/2006 | Knapp et al. | 84/724 |
| 2007/0056435 | A1 * | 3/2007 | Juszkiewicz et al. | 84/726 |
| 2010/0307324 | A1 * | 12/2010 | Takabayashi | 84/731 |
| 2012/0240752 | A1 * | 9/2012 | Matsuoka et al. | 84/731 |

FOREIGN PATENT DOCUMENTS

| | | | | |
|---|---|---|---|---|
| EP | 0 213 865 | A2 | 3/1987 | |
| EP | 2287834 | A2 * | 2/2011 | |
| GB | 2070313 | A * | 9/1981 | G10H 3/18 |
| JP | S55-175194 | U | 12/1980 | |
| JP | H02-27199 | U | 2/1990 | |
| JP | 07-239684 | | 9/1995 | |
| JP | 07-239685 | | 9/1995 | |

OTHER PUBLICATIONS

European Search Report issued for corresponding application EP 10005701.7, mailing date Feb. 20, 2014.

Japanese Office Action issued for corresponding application JP 2009-133812, mailing date Oct. 1, 2013 (with English translation).

* cited by examiner

PICKUP UNIT OF ELECTRIC STRINGED INSTRUMENT

BACKGROUND OF THE INVENTION

1. Field of the Invention

The present invention relates to pickup units of electric stringed instruments, which pick up vibrations of strings and convert them into electric signals.

The present application claims priority on Japanese Patent Application No. 2009-133812 (Filing Date: Jun. 3, 2009), the content of which is incorporated herein by reference.

2. Description of the Related Art

Conventionally, electric stringed instruments such as electric guitars and acoustic guitars have been equipped with pickup units that pick up vibrations of saddles supporting strings so as to generate electric signals. Conventionally-known examples of pickup units of electric stringed instruments are disclosed in Patent Documents 1 and 2, as follows:

Patent Document 1: Japanese Patent Application Publication No. H07-239684

Patent Document 2: Japanese Patent Application Publication No. H07-239685

FIGS. 5A and 5B show the conventionally-known constitution of a pickup unit 50 adapted to an electric stringed instrument. The pickup unit 50 is fixed inside a recess 52A of a lower bridge 52 attached to an exterior board 51 of an electric stringed instrument. The pickup unit 50 is constituted of a U-shaped frame 55 (having a U-shape in side view, see FIG. 5B) installed in the recess 52A, a vibrator 57 which is inserted and held by the U-shape frame 55 and of which upper end supports strings 56, a plurality of piezoelectric elements 58 which are interposed between the U-shape frame 55 and the vibrator 57 and which are disposed just below the strings 56 respectively, and a shim 59 interposed between the bottom portion of the recess 52A and the U-shape frame 55.

The vibrator 57 is constituted of a saddle 60 made of a resin, and a lead plate 61 which is fixed to the lower surface of the saddle 60 and which conducts with the upper surface of the piezoelectric elements 58. Owing to the downward force exerted by the strings 56 which are stretched under tension, the piezoelectric elements 58 are brought into contact with the lead plate 61. Upon playing an electric stringed instrument, vibrations of the strings 56 are transmitted to the vibrator 57 (supporting the strings 56) toward the piezoelectric elements 58, which are thus deformed in shape to generate electricity. Thus, it is possible to convert vibrations of the stings 56 into electric signals. In the preparation of an electric stringed instrument, manual operation is needed to adjust the heights of the strings 56 and to adjust the projecting length of the saddle 60 above the lower bridge 52. This manual operation is performed using a plurality of shims 59 having different thicknesses, wherein each of the shims 59 is arbitrarily selected and applied to the pickup unit 50, thus performing the above mechanical adjustment.

The pickup unit 50 shown in FIGS. 5A and 5B is characterized in that the downward force of the strings 56 may fluctuate during the performance of an electric stringed instrument, and the saddle 60 may be inclined toward the neck of an electric stringed instrument so as to loosen the tight contact between the piezoelectric elements 58 and the lead plate 61 when the strings 56 are being stretched. This destabilizes the contact state between the piezoelectric elements 58 and the lead plate 61, so that the piezoelectric elements 58 may not deform to readily follow up with vibrations of the saddle 60. That is, the pickup unit 50 suffers from a great mechanical loss in transmitting vibrations to the piezoelectric elements 58, a destabilization of vibrations of the strings 56, and a difficulty in precisely converting vibrations of the strings 56 into electric signals.

In addition, the pickup unit 50 suffers from a difficulty in maintaining the uniform contact state between the piezoelectric elements 58 and the lead plate 61, which in turn readily causes dispersions regarding the tone volume of the strings 56. The piezoelectric elements 58 inherently possess an inclination to greatly fluctuate in electric power generation depending upon a subtle difference of the contact state with the lead plate 61, thus easily revealing the above drawbacks. The saddle 60 of which base portion has a low precision of smoothness may induce a great fluctuation of electric power generation among the piezoelectric elements 58, which in turn causes dispersions regarding the tone volume of the strings 56. For this reason, a further process is needed to improve the precision of smoothness after the formation of the saddle 60 made of a thermosetting resin.

The pickup unit 50 of FIGS. 5A and 5B is simply assembled such that the piezoelectric elements 58, the lead plate 61, and the saddle 60 are sequentially mounted in the recess 52A of the lower bridge 52 on the exterior surface 51 of an electric stringed instrument. For this reason, even when the surface of the lead plate 61 is smoothed, it is difficult to practically secure the same contact state among the piezoelectric elements 58 with the lead plate 61. Since the contact pressure of the piezoelectric elements 58 normally fluctuates owing to vibrations of the strings 56, the piezoelectric elements 58 partially contacts with the lead plate 61 with respect to micro-time. This degrades the sound quality and tone color of an electric stringed instrument. Since the tone color of an electric stringed instrument is inherently correlated to the initial plucking period, fluctuations of contact pressure greatly affect the tone color of an electric stringed instrument as they are apt to increase in the initial plucking period.

Furthermore, the shim 59 disposed in the bottom portion of the recess 52A of the lower bridge 52 causes a mechanical loss in transmitting vibrations to the lower bridge 52 and the body of an electric stringed instrument. For this reason, it is difficult to reproduce a live sound of an electric stringed instrument with the conventionally-known constitution of the pickup unit 50.

SUMMARY OF THE INVENTION

It is an object of the present invention to provide a pickup unit of an electric stringed instrument, which is able to efficiently transmit vibrations of strings to piezoelectric elements and which improves the tone color and sound quality by minimizing dispersions regarding the tone volume of strings.

It is another object of the present invention to provide a pickup unit of an electric stringed instrument, which guarantees the smooth height adjustment of strings and which markedly reduces a mechanical loss in transmitting vibrations to a lower bridge.

It is a further object of the present invention to provide a pickup unit of an electric stringed instrument, in which piezoelectric elements can be easily disassembled from support members.

The present invention is directed to a pickup unit installed in a lower bridge of an electric stringed instrument. The pickup unit is constituted of a vibrator supporting a plurality of strings, a support which is installed in the lower bridge so as to support the vibrator, a plurality of piezoelectric elements which covert vibrations of the strings transmitted thereto via the vibrator into electric signals, and at least one presser member which is interposed between the support and the vibrator so as to apply a pressure pressing the piezoelectric elements onto the vibrator.

In the above, the presser member is adjusted in the pressure applied to the piezoelectric elements. The support is constituted of a frame holding the vibrator and a base which is fixed to the frame and is mounted inside the lower bridge, wherein the lower surface of the base has a processability in cutting. The piezoelectric elements are each coupled with tuning plates via conductive bonds and are interposed between the vibrator and the support. The support includes at least one positioning projection which regulates the positioning of the piezoelectric element in the alignment direction of the strings. The vibrator includes a printed circuit board which is connected to a lead via a connector detachably attached to the vibrator.

The pickup unit of the present invention is designed such that the presser member (e.g. screws) presses the piezoelectric elements onto the vibrator, hence, it is possible to prevent the contact state between the vibrator and the piezoelectric elements from fluctuating when the downward force of the strings applied to the vibrator fluctuates or the vibrator is forced to incline during a rendition of an electric stringed instrument. This makes it possible for the piezoelectric elements to readily deform to follow up with vibration of the vibrator, thus achieving various effects. For example, it is possible to efficiently transmit vibrations of strings to the piezoelectric elements without any transmission loss, thus reproducing a rich and live sound. In addition, it is possible to improve the tone color and sound quality of an electric stringed instrument by way of the precise detection and rendition of vibrations of strings.

The presser member uniformizes the pressure applied to the piezoelectric elements and thereby uniformizes the contact state between the piezoelectric elements and the vibrator. Even when the lower surface of the vibrator has a low degree of smoothness, it is possible to reliably prevent the piezoelectric elements from unexpectedly fluctuating in terms of the electric power generation; hence, it is possible to prevent the occurrence of dispersions among the tone colors of the respective strings.

Using the "adjustable" presser member, it is possible to apply the optimum contact pressure to the piezoelectric elements generating electric signals.

Owing to the processability in cutting on the lower surface of the base of the support, it is possible to adjust the projecting length of the vibrator above the lower bridge and to adjust the heights of the strings with ease. This eliminates the shim which is conventionally used for the pickup unit of an electric stringed instrument; hence, it is possible to suppress the mechanical loss of transmitting vibrations of strings to the lower bridge and the body of an electric stringed instrument, thus reproducing a good live sound.

In addition, it is possible to reliably prevent the piezoelectric elements coupled with the tuning plates from partially contacting with the vibrator in the initial plucking period in which strings are plucked to vibrate with maximum amplitudes; hence, it is possible to improve the fidelity of piezoelectric elements generating electric signals. This prevents unwanted fluctuations of the tone color and degradation of the sound quality in reproduction. The tuning plates may serve as a tuning filter rectifying vibrations transmitted to the lower bridge from strings, wherein it is possible to suppress or eliminate unwanted components of vibrations (e.g. vibrations of a certain register) and noise. In addition, the tuning plates are not necessarily placed in direct contact with the vibrator and are thereby physically separated from the vibrator; this makes it possible for the technician (or engineer) to easily disassemble the piezoelectric elements and the vibrator.

Furthermore, the positioning projection of the support makes it easy for the technician to establish the precise positioning with respect to the piezoelectric elements relative to the support; this facilitates the setting operation, reduces the workload, and speeds up the assembling operation.

BRIEF DESCRIPTION OF DIE DRAWINGS

These and other objects, aspects, and embodiments of the present invention will be described in more detail with reference to the following drawings.

DESCRIPTION OF THE PREFERRED EMBODIMENT

Figure 1:
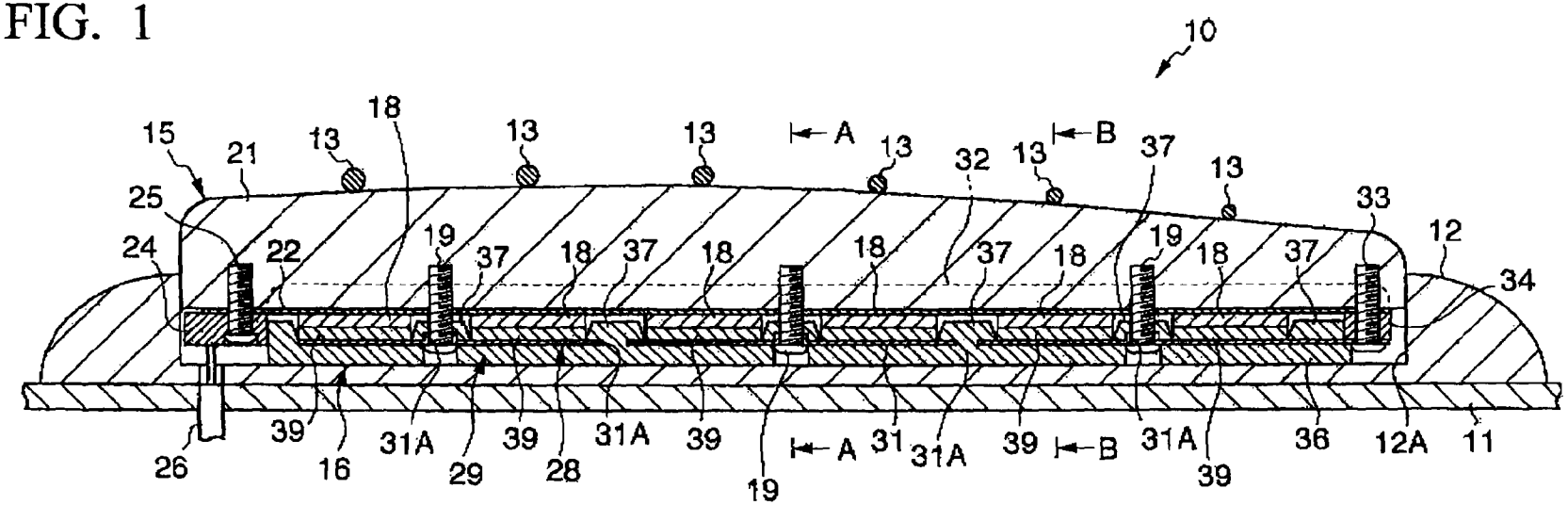
FIG. 1 is a traverse sectional view showing the constitution of a pickup unit of an electric stringed instrument according to a preferred embodiment of the present invention.
Figure 2:
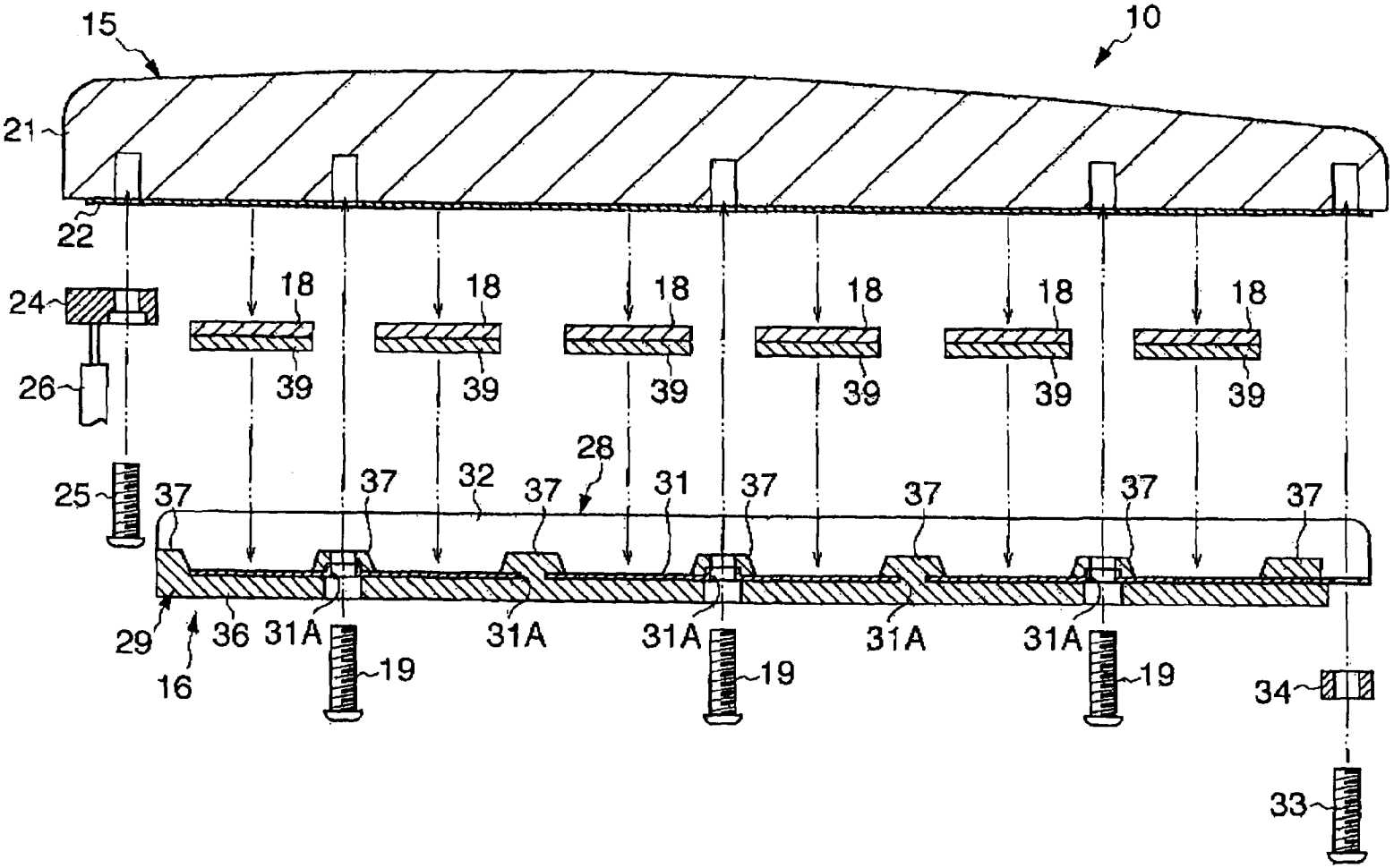
FIG. 2 is an exploded view partly in cross section showing the assembly of constituent parts of the pickup unit.

The present invention will be described in further detail by way of examples with reference to the accompanying drawings.

As shown in FIGS. 1 to 4, a pickup unit 10 according to a preferred embodiment of the present invention is installed in an electric stringed instrument such as an electric guitar or an acoustic guitar. The pickup unit 10 is installed in a lower bridge 12 formed on an exterior surface 11 (see FIG. 1) constituting the body of an electric stringed instrument. The pickup unit 10 is constituted of a vibrator 15 of which an upper end supports six strings 13, a support 16 which is fixed inside a recess 12A of the lower bridge 12 so as to support the vibrator 15, a plurality of piezoelectric elements 18 which convert vibrations of the strings 13, transmitted thereto via the vibrator 15, into electric signals, and a plurality of presser members 19 which are interposed between the vibrator 15 and the support 16.

The vibrator 15 is constituted of a saddle 21, which is made of a resin and elongated in the alignment direction of the strings 13, and a printed circuit board 22 disposed on the lower surface of the saddle 21. The upper surface of the printed circuit board 22 is entirely fixed to the lower surface of the saddle 21 via the adhesive. The upper surface of the printed circuit board 22 serves as a ground surface, while the lower surface serves as a lead-fabricated surface. Near the left-side position of the support 16, a connector 24 is detachably attached to the lower surface of the vibrator 15 via a screw 25, which is screwed into the lower surface of the saddle 21. A pair of lead terminals is integrally formed in the connector 24, wherein one lead terminal is connected to the lead-fabricated surface of the printed circuit board 22 and is soldered with the lead terminal of a lead 26, while the other lead terminal is connected to the ground surface of the printed circuit board 22 and is soldered with the ground terminal of the lead 26. That is, the printed circuit board 22 is connected to the lead 26 via the connector 24.

The support 16 is constituted of a frame 28 made of a metal supporting the lower end of the vibrator 15 and a base 29 made of a resin (e.g. a urea resin) fixed to the frame 28. The support 16 is formed by unifying the frame 28 and the base 29 together.

Figure 3:
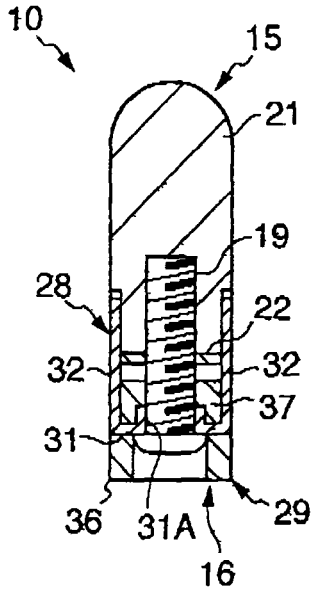
FIG. 3 is an enlarged cross-sectional view taken along line A-A in FIG. 1.
Figure 4:
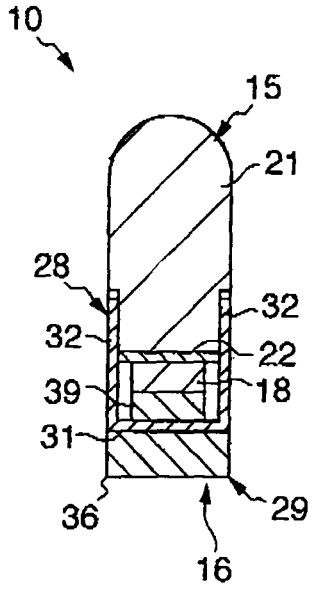
FIG. 4 is an enlarged cross-sectional view take along line B-B in FIG. 1.
Figure 5A:
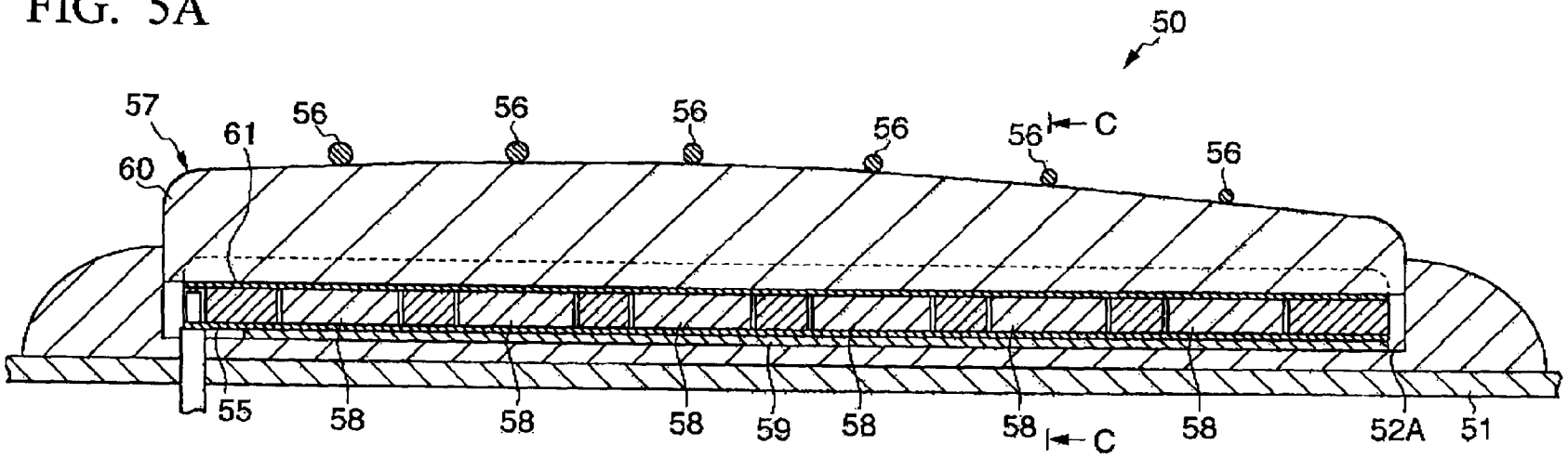
FIG. 5A is a traverse sectional view showing the constitution of a conventionally-known pickup unit adapted to an electric stringed instrument.
Figure 5B:
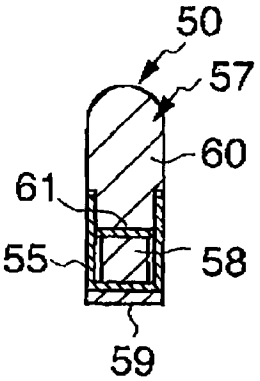
FIG. 5B is a cross-sectional view taken along line C-C in FIG. 5A.

As shown in FIGS. 3 and 4, the frame 28 is constituted of a base portion 31 and a pair of side portions 32 vertically interconnected to left and right ends of the base portion 31, wherein the frame 28 is formed in a U-shape in side view, partially holding the lower end of the vibrator 15. A plurality of holes 31A is formed in the base portion 31 of the frame 28, wherein each hole 31A is positioned just below the midpoint between the adjacent strings 13. A ground screw 33 is put into the right end of the frame 28 which horizontally projects from the right end of the base 29. The ground screw 33 is screwed into the lower surface of the saddle 21 so as to nm through the frame 28 and the printed circuit board 22 as well as a spacer 34 interposed between them. The spacer 34 is connected to the ground surface of the printed circuit board 22 via a through-hole, so that the frame 28, the spacer 34, and the ground surface of the printed circuit board 22 are electrically conducted with each other via the ground screw 33.

The base 29 is positioned beneath and along the lower surface of the bottom portion 31 of the frame 28 and is constituted of a foot portion 36 mounted on the bottom portion of the recess 12A and a plurality of positioning projections 37 which project above the foot portion 36. The lower surface of the foot portion 36 of the base 29 possesses a processability in cutting, wherein it is subjected to cutting using an appropriate tool so as to change the distance from the bottom portion of the recess 12A to the upper end of the saddle 21, thus adjusting the heights of the strings 13. It is preferable that the maximum cutting thickness in the foot portion 36 of the base 29 be set to 1.5 mm. In this connection, a gap is formed between the bottom portion of the recess 12A and the connector 24 so as to prevent the connector 24 from contacting the bottom portion of the recess 12A irrespective of the cutting of the foot portion 36 of the base 29.

The positioning projections 37 are formed to adjoin together in the alignment direction (i.e. the left-right direction) of the strings 13 in connection with the piezoelectric elements 18, thus regulating the lateral movements of the piezoelectric elements 18. Each of the positioning projections 37 is disposed around each of the holes 31A above the left and right ends of the base portion 31 of the frame 28. The positioning projections 37 are unified with the frame 28 together with the foot portion 36 by way of the outsert molding using a resin material.

Six piezoelectric elements 18 are aligned just below the six strings 13. The piezoelectric elements 18 are arranged inside the frame 28 in the same polarization direction, in which each piezoelectric element 18 is polarized in the thickness direction so that charges are generated on both the upper and lower faces thereof. The upper faces of the piezoelectric elements 18 are bonded onto the lower surface of the printed circuit board 22. Tuning plates (or plate members) 39 are attached to the lower faces of the piezoelectric elements 18; hence, the piezoelectric elements 18 bonded together with the tuning plates 39 are interposed between the saddle 21 and the support 16. Herein, non-hardening materials having conductivity and adhesiveness are used as bonds applied to the upper and lower faces of the piezoelectric elements 18. That is, the piezoelectric elements 18 are connected to the vibrator 15 and the tuning plates 39 with the adequate adhesiveness. This guarantees that a certain level of the contact state is maintained between the piezoelectric elements 18 and the printed circuit board 22 over a lapse of time even when the strings 13 are plucked with a relatively strong force. In this connection, the above bonds may embrace both-side adhesive tapes having the above property. The height of the positioning projection 37 projecting above the base portion 31 of the frame 28, is smaller than the overall thickness of the piezoelectric element 18 and the tuning plate 39 unified together, so that a small gap is formed between the upper end of the positioning projection 37 and the lower surface of the printed circuit board 22.

The tuning plates 39 are composed of a metal such as a brass. The tuning plate 39 collectively serve as a tuning filter suppressing or eliminating unwanted harmonics and noise, while they are devoted to effects of firming up median and base tones and effects of sustaining sound by appropriately changing the material and thickness thereof. The timing plates 39 are not necessarily fixed to but simply mounted on the base portion 31 of the frame 28; hence, it is possible to easily disassemble them from the support 16 and to easily perform maintenance of the piezoelectric elements 18.

The presser members 19 are constituted of three screws which are put into the lower surface of the vibrator 15 from the lower surface of the support 16 and which are aligned in the alignment direction (i.e. the left-right direction) of the strings 13. The screws of the presser members 19 run through the positioning projections 37 which are formed via the holes 31A of the base portion 31 of the frame 28, wherein a first screw is positioned just below halfway between the lowest-pitch string 13 and its adjacent string 13, a second screw is positioned just below halfway between the highest-pitch string 13 and its adjacent string 13, and a third screw is positioned just below halfway between the two strings 13 in the middle of the six strings 13. Screwing the presser member 19 makes the base portion 31 of the frame 28 approach the lower surface of the vibrator 15, thus producing the upward pressure pressing the piezoelectric elements 18 toward the vibrator 15. The piezoelectric elements 18 are tightly held between the lower surface of the printed circuit board 22 and the base portion 31 of the frame 28 and are subjected to upward/downward compressive forces independently of the downward pressure produced by the strings 13 being stretched under tension. In other words, the present embodiment is able to apply compressive forces to the piezoelectric elements 18 before the strings 13 are stretched. It is possible to arbitrarily adjust the pressures by changing the screwing torques of the presser members 19, wherein a torque driver or the like is used to apply a preset torque to the presser members 19, thus uniformizing the compressive pressures applied to the piezoelectric elements 18.

In a rendition of an electric stringed instrument of which strings 13 are being plucked, vibrations of the strings 13 are transmitted to the piezoelectric elements 18 via the vibrator 15 so that the piezoelectric elements 18 convert them into electric signals. Electric signals of the piezoelectric elements 18 are output to an external device (not shown) via the printed circuit board 22 and the lead 26, so that the corresponding sound (or an artificial electronic sound) is reproduced.

The present embodiment is designed such that the piezoelectric elements 18 are pressed onto the printed circuit board 22 by means of the presser members 19; hence, it is possible to prevent the contact state between the piezoelectric elements 18 and the printed circuit board 22 from being unexpectedly altered. Thus, it is possible to efficiently transmit vibrations of the strings 13 to the piezoelectric elements 18, thus achieving a high sound quality. In addition, it is possible to establish the uniform contact state between the piezoelectric elements 18 and the printed circuit board 22 and to uniformize the compressive pressures applied to the piezoelectric elements 18. In short, it is possible to suppress unwanted fluctuations of electric power generation of the piezoelectric elements 18 and to maintain a good balance in tone volume between the strings 13.

The present embodiment is designed such that the piezoelectric elements 18 are bonded to the printed circuit board 22 and the tuning plates 39 by use of the above bonds; hence, it is possible to prevent them from partially contacting each other with respect to micro-time in the initial plucking period significantly affecting the tone color of an electric stringed instrument. Thus, it is possible to precisely transmit vibrations of the strings 13 to the piezoelectric elements 18, and it is therefore possible to reproduce rich and live sounds of an electric stringed instrument. In addition, the connector 24 is formed independently of the support 16 and is connectible to the printed circuit board 22; hence, it is possible to prevent the connector 24 and the lead 26 from disturbing the adjustment of the thickness of the foot portion 36 of the vibrator 15 via cutting.

The present invention is not necessarily limited to the above embodiment and examples, which can be appropriately modified in various ways within the scope of the invention as defined in the appended claims, since the skilled person in the art may be able to readily alter the names, shapes, sizes, arrangements, and illustrations of the constituent parts of the pickup unit of an electric stringed instrument.

For example, it is possible to change the number of the presser members 19 and their positions such that the presser members 19 are positioned just below all the midpoints of the adjacent six strings 13, they are positioned at both the left and right ends of the saddle 21, or one presser member 19 is arranged at the intermediate position between the left and right ends of the saddle 21.

In addition, it is possible to modify the presser members 19 in terms of the structure or mechanism as long as they are able to press the piezoelectric elements 18 onto the vibrator 15; for example, it is possible to employ a rod and a lock mechanism regulating the retractable motion of the rod instead of the screw of the presser member 19.

What is claimed is:

1. A pickup unit installed in a bridge of an electric stringed instrument, comprising:

a support member;

a bridge;

a vibrator extending into and supported by the support member;

a plurality of piezoelectric elements located in and supported by the support member, the piezoelectric elements being in contact with the vibrator so that when one or more strings are placed in contact with the vibrator and the strings are vibrated, the vibrations are transmitted to the piezoelectric elements and converted into electric signals; and at least one presser member for causing relative movement between the support member and the vibrator in such a manner that the piezoelectric elements are pressed into contact with the vibrator.

2. The pickup unit according to claim 1, wherein the presser member adjustably moves the support member toward the vibrator so as to adjust the force with which the piezoelectric members are pressed into contact with the vibrator.

3. The pickup unit according to claim 1, wherein the piezoelectric members are adhesively connected to the vibrator.

4. The pickup unit according to claim 1, wherein respective tuning plates are positioned between each respective piezoelectric element and the support member.

5. The pickup unit according to claim 4, wherein the tuning plates are adhesively coupled to their respective piezoelectric element.

6. The pickup unit according to claim 4, wherein the tuning plates are made of metal.

7. The pickup unit according to claim 4, wherein the tuning plates collectively serve as a tuning filter.

8. The pickup unit according to claim 1, wherein the presser member comprises a screw.

9. The pickup unit according to claim 1, wherein the vibrator is elongated along an axis and there are three presser members, each located at a different location along the axis.

10. The pickup unit according to claim 1, further including a plurality of positioning projections which regulate the positioning of the piezoelectric elements along an elongated axis of the vibrator.

11. The pickup unit according to claim 10, wherein the presser extends through a respective one of the positioning projections.

12. The pickup unit according to claim 10, wherein there are a plurality of presser members, each presser member extending through a respective one of the positioning projections.

13. The pickup unit according to claim 1, wherein the support member comprises a frame holding both the vibrator and the piezoelectric elements and a base which is fixed to the frame.

14. The pickup unit according to claim 1, wherein the frame is mounted in a recess formed in a lower bridge of the stringed instrument.

15. The pickup unit according to claim 1, wherein the vibrator comprises a saddle and a printed circuit board connected to a lower portion of the saddle.

* * * * *